US009694479B2

(12) United States Patent
Yeh

(10) Patent No.: US 9,694,479 B2
(45) Date of Patent: Jul. 4, 2017

(54) SOCKET WRENCH

(71) Applicant: Chien-Wen Yeh, Taichung (TW)

(72) Inventor: Chien-Wen Yeh, Taichung (TW)

( * ) Notice: Subject to any disclaimer, the term of this patent is extended or adjusted under 35 U.S.C. 154(b) by 337 days.

(21) Appl. No.: 14/592,460

(22) Filed: Jan. 8, 2015

(65) Prior Publication Data

US 2015/0258666 A1 Sep. 17, 2015

(30) Foreign Application Priority Data

Mar. 17, 2014 (TW) ..... 103109941 A

(51) Int. Cl.
*B25B 13/46* (2006.01)
*B25B 13/04* (2006.01)
*B25B 23/00* (2006.01)

(52) U.S. Cl.
CPC ..... *B25B 23/0035* (2013.01); *B25B 13/463* (2013.01)

(58) Field of Classification Search
CPC . B25B 23/0007; B25B 23/0035; B25B 13/04; B25B 13/463
USPC ..... 81/60
See application file for complete search history.

(56) References Cited

U.S. PATENT DOCUMENTS 4,328,720 A * 5/1982 Shiel ..... B25B 13/06 81/124.6
4,535,658 A * 8/1985 Molinari ..... B25B 23/0035 81/177.85
4,692,073 A * 9/1987 Martindell ..... B23B 31/1071 279/75
6,481,315 B1 * 11/2002 Chang ..... B25B 13/463 81/125
7,111,527 B1 * 9/2006 Lee ..... B25B 23/0035 81/58.1
9,038,506 B1 * 5/2015 Huang ..... B25B 13/462 81/60
2003/0121371 A1 * 7/2003 Chiu ..... B25B 23/0035 81/63.1
2015/0290783 A1 * 10/2015 Liu ..... B25B 23/0035 81/60

* cited by examiner

*Primary Examiner* — Hadi Shakeri

(57) ABSTRACT

A socket wrench contains: a body including a first face, a second face, and an accommodating cavity having a stop ring arranged on the first face. A ratchet holder is accommodated in the accommodating cavity and has a polygonal groove, a first peripheral segment, a second peripheral segment, and a toothed portion. The first peripheral segment is inserted through the stop ring, the toothed portion engages with a ratchet driving device beside the accommodating cavity, and the second peripheral segment is inserted into the second face and has an elastic element fitted thereon. A clamping device includes a guiding portion having a small-diameter contacting section and a large-diameter retracting section. The small-diameter contacting section is located adjacent to the first face, and the first peripheral segment has at least one locking member moving in the polygonal groove along the small-diameter contacting section and the large-diameter retracting section.

13 Claims, 22 Drawing Sheets

SOCKET WRENCH

FIELD OF THE INVENTION

The present invention relates to a socket wrench which fits with a socket tool securely and replaces the socket tool easily.

BACKGROUND OF THE INVENTION

Referring to FIGS. 1 and 2, a conventional socket wrench 10 contains a ratchet holder 11 accommodated on one end thereof, and the toothed holder 11 includes a polygonal groove 111 defined therein, the polygonal groove 111 of the ratchet holder 11 has a slot 112 arranged therein to retain a C-ring 12. Furthermore, a socket tool 20 has a hexagonal fitting segment 201, and the hexagonal fitting segment 201 has a plurality of notches 202 formed on plural corners thereof, such that when the hexagonal fitting segment 201 of the socket tool 20 fits with the polygonal groove 111 of the ratchet holder 11, the C-ring 12 retains with the plurality of notches 202 of the socket tool 20, thus avoiding the socket tool 20 removing from the polygonal groove 111 of the ratchet holder 11.

However, the C-ring 12 cannot retain with the plurality of notches 202 of the socket tool 20 fixedly, and the socket tool 20 removes from the socket wrench 10 easily.

The present invention has arisen to mitigate and/or obviate the afore-described disadvantages.

SUMMARY OF THE INVENTION

The primary objective of the present invention is to provide a socket wrench which fits with a socket tool securely.

Another objective of the present invention is to provide a socket wrench which replaces the socket tool easily.

To obtain above-mentioned objectives, a socket wrench provided by the present invention contains a body.

The body includes a first face, a second face, and an accommodating cavity defined in at least one end thereof, wherein the accommodating cavity has a stop ring arranged on the first face.

A ratchet holder is accommodated in the accommodating cavity of the body and has a polygonal groove formed therein, the ratchet holder also has a first peripheral segment and a second peripheral segment both arranged on an outer wall thereof. The ratchet holder further has a toothed portion defined between the first peripheral segment and the second peripheral segment, wherein the first peripheral segment is inserted through the stop ring of the accommodating cavity, the toothed portion engages with a ratchet driving device beside the accommodating cavity of the body, and the second peripheral segment of the ratchet holder is inserted into the second face of the body and has an elastic element fitted thereon.

A clamping device includes a guiding portion arranged on an inner wall of the stop ring of the body, and the guiding portion has a small-diameter contacting section and a large-diameter retracting section, wherein the small-diameter contacting section is located adjacent to the first face of the body, and the first peripheral segment of the ratchet holder has at least one locking member expanding or retracting in the polygonal groove along the small-diameter contacting section and the large-diameter retracting section of the guiding portion.

DETAILED DESCRIPTION OF THE PREFERRED EMBODIMENTS

Figure 1:
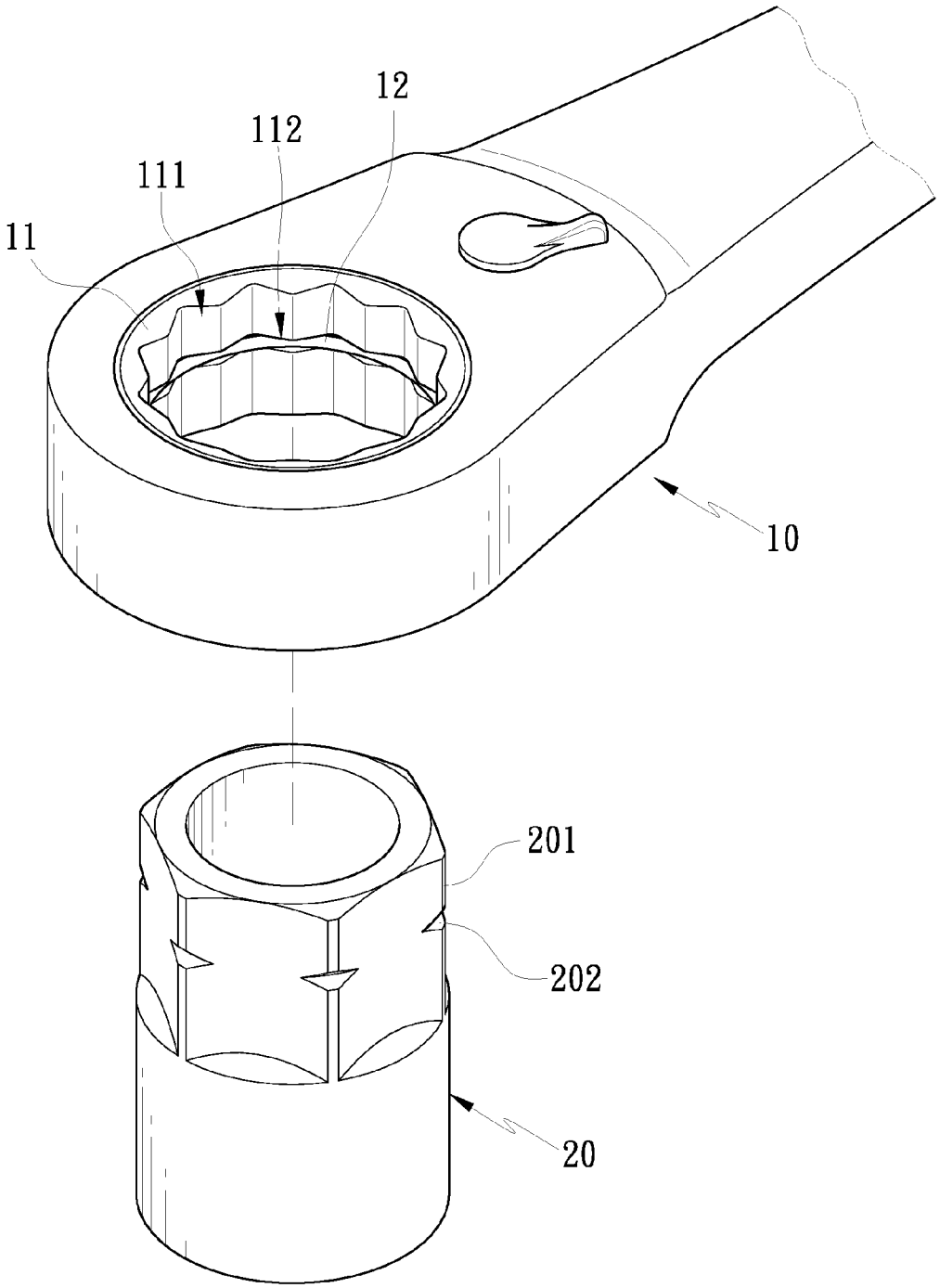
FIG. 1 PRIOR ART
FIG. 1 is a perspective view of a conventional socket wrench and a socket tool.
Figure 2:
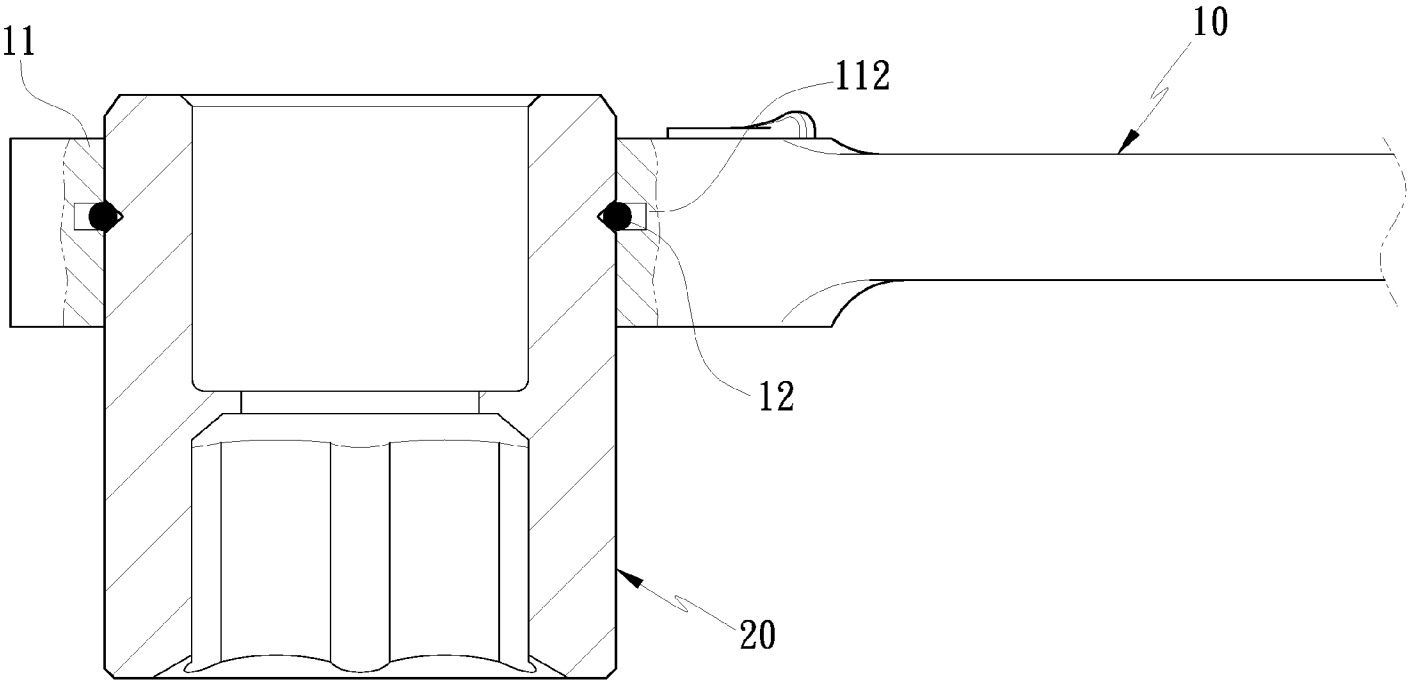
FIG. 2 PRIOR ART
FIG. 2 is a cross sectional view showing the operation of the conventional socket wrench and the socket tool.
Figure 3:
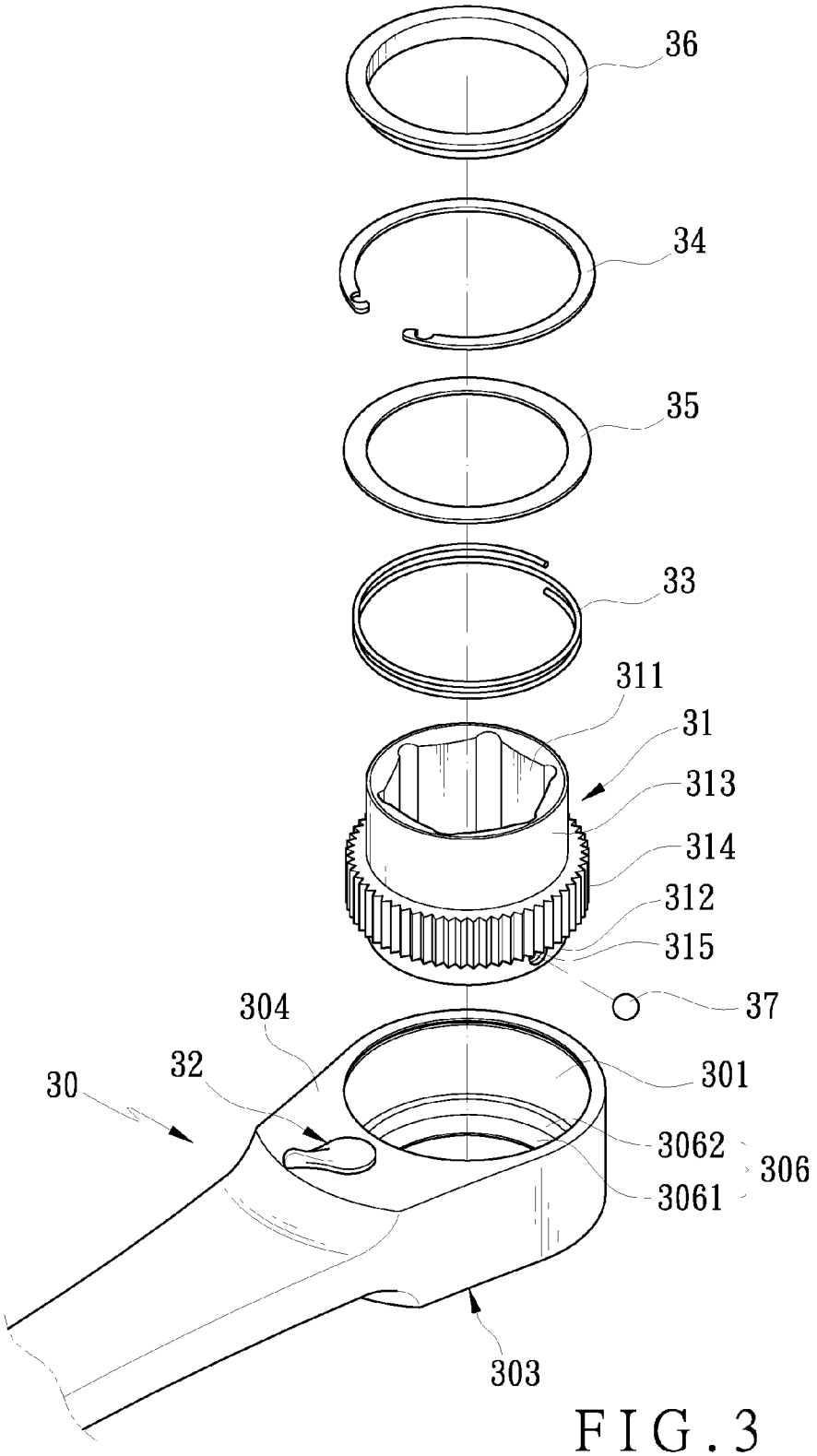
FIG. 3 is a perspective view showing the exploded components of a socket wrench according to a first embodiment of the present invention.
Figure 4:
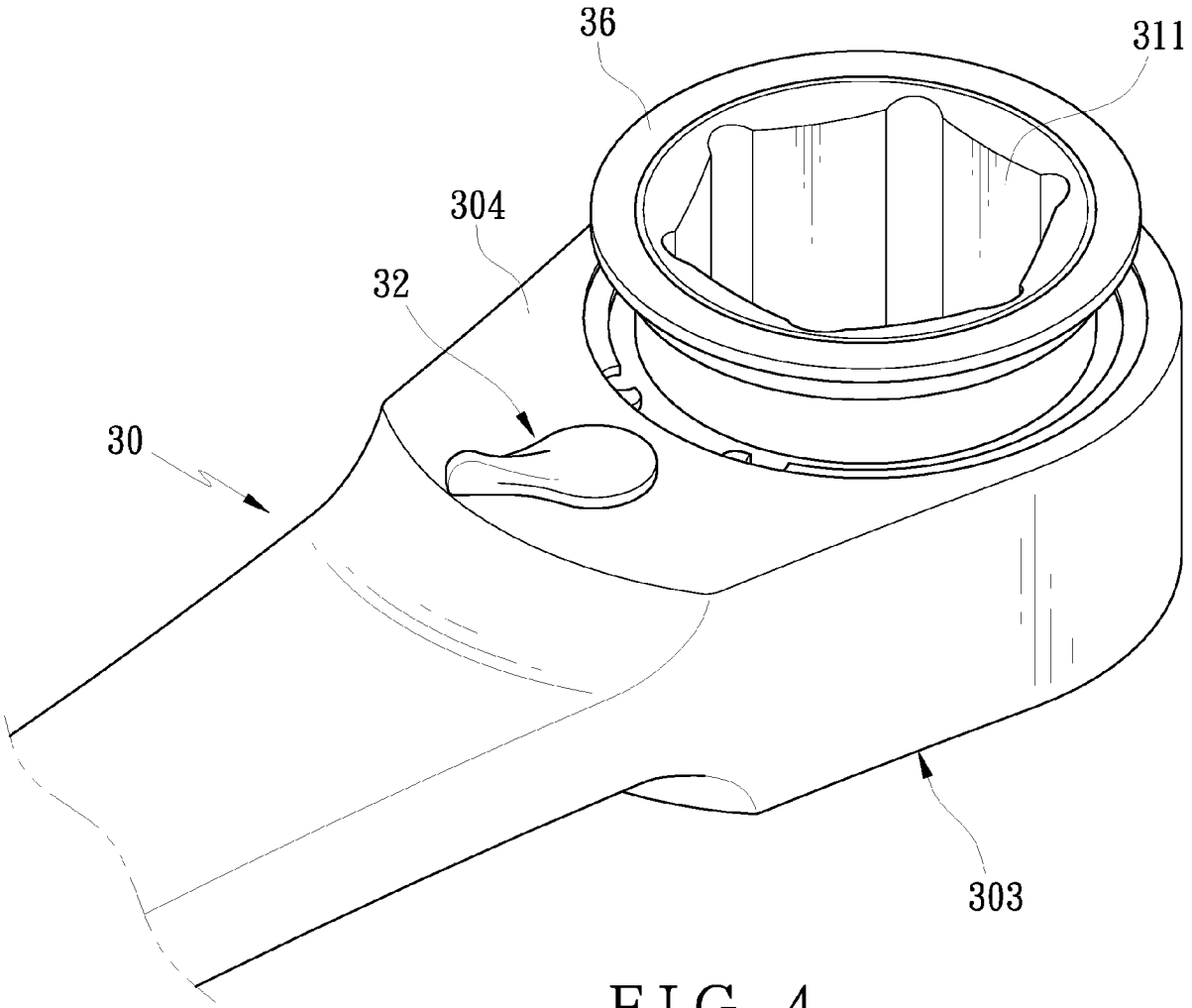
FIG. 4 is a perspective view showing the assembly of a part of the socket wrench according to the first embodiment of the present invention.
Figure 5:
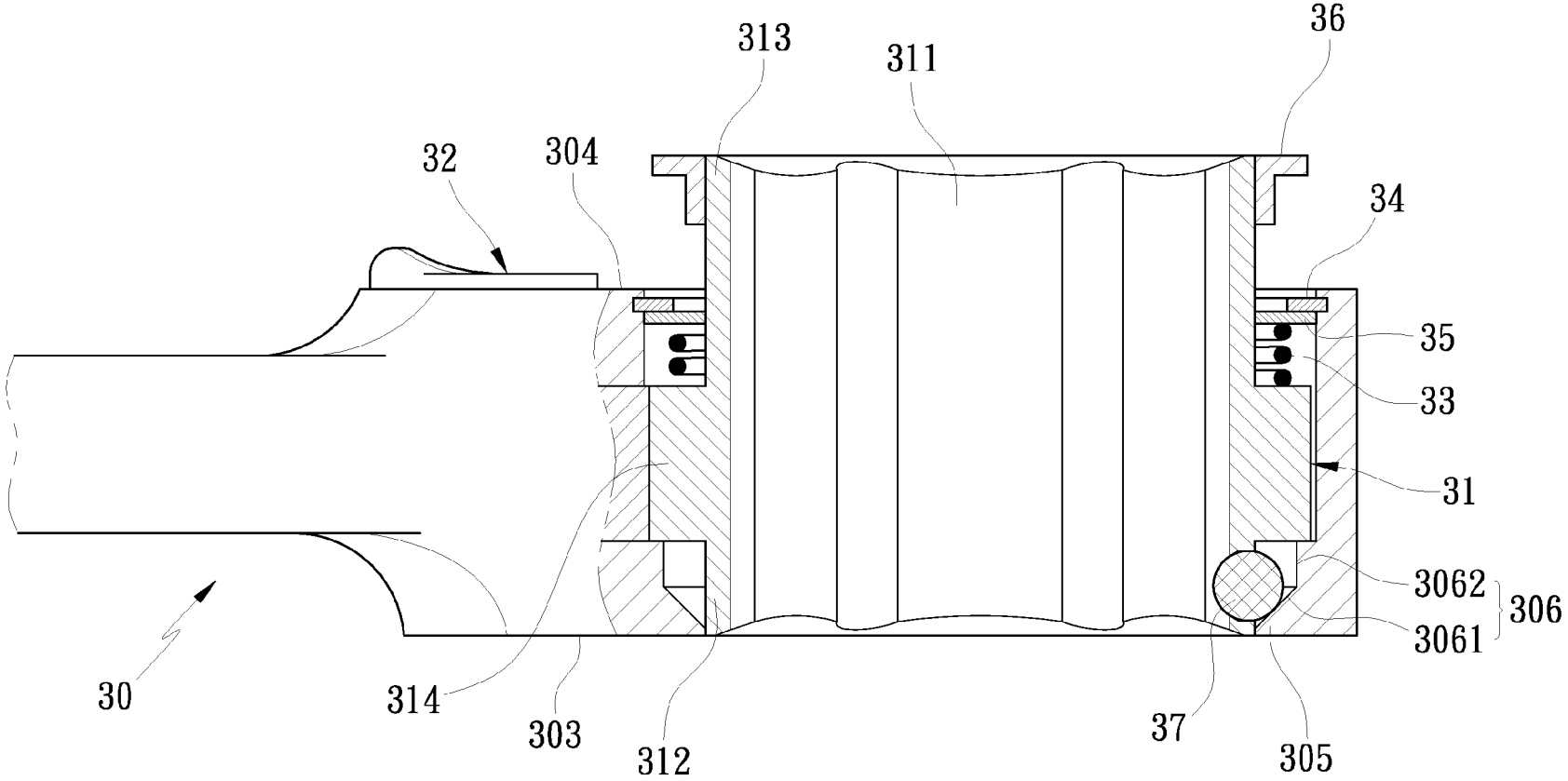
FIG. 5 is a cross sectional view showing the assembly of a part of the socket wrench according to the first embodiment of the present invention.

With reference to FIGS. 3 to 5, a socket wrench according to a first embodiment of the present invention comprises: a body 30. The body 30 includes an accommodating cavity 301 defined in at least one end thereof, a first face 303, and a second face 304. The accommodating cavity 301 of the body 30 has a stop ring 305 arranged on the first face 303. In this embodiment, the stop ring 305 are directly formed on the first face 303 of the body 30, and a ratchet holder 31 is accommodated in the accommodating cavity 301 and has a polygonal groove 311 formed therein to fit with a socket tool. The ratchet holder 31 also has a first peripheral segment 312 and a second peripheral segment 313 both arranged on an outer wall thereof. The ratchet holder 31 further has a toothed portion 314 defined between the first peripheral segment 312 and the second peripheral segment 313, wherein the first peripheral segment 312 is inserted through the stop ring 305 of the accommodating cavity 301, an outer diameter of the toothed portion 314 is greater than those of the first peripheral segment 312 and the second peripheral segment 313, such that one end of the toothed portion 314 abuts against an inner wall of the stop ring 305. In addition, the toothed portion 314 engages with a ratchet driving device 32 beside the accommodating cavity 301 of the body 30, such that the ratchet driving device 32 drives the ratchet holder 31 to rotate in the accommodating cavity 301 of the body 30. Since the ratchet driving device 32 is a well-known art, further remarks are omitted. The second peripheral segment 313 of the ratchet holder 31 is inserted into the second face 304 of the body 30, and the second peripheral segment 313 has an elastic element 33 fitted thereon, wherein a first end of the elastic element 33 abuts against the toothed portion 314, and a second end of the elastic element 33 is limited by a limiting element 34, such that when the elastic element 33 is pressed, the ratchet holder 31 moves toward the second face 304 of the body 30. In this embodiment, the second end of the elastic element 33 abuts against a circular loop 35 fitted on the second peripheral segment 313, and the circular loop 35 is limited by the limiting element 34, thus positioning the ratchet holder 31 in the accommodating cavity 301. In this embodiment, the limiting element 34 is a resilient C retainer for abutting an inner wall of the accommodating cavity 301, and the circular loop 35 and the ratchet holder 31 are limited in the accommodating cavity 301. In this embodiment, the second peripheral segment 313 of the ratchet holder 31 extends out of the second face 304 of the body 30 and has an annular fixer 36 disposed thereon, such that the annular fixer 36 is pulled so that the ratchet holder 31 presses the elastic element 33 to move toward the second face 304 of the body 30. Furthermore, the sock wrench further comprises a clamping device, wherein the clamping device includes a guiding portion 306 arranged on the inner wall of the stop ring 305 of the accommodating cavity 301, and the guiding portion 306 has a small-diameter contacting section 3061 and a large-diameter retracting section 3062, wherein the small-diameter contacting section 3061 is located adjacent to the first face 303 of the body 30, and the small-diameter contacting section 3061 and the large-diameter retracting section 3062 are connected together to form a continuously tilted surface or a continuously stepped surface. In this embodiment, the small-diameter contacting section 3061 is a tilted surface, and the large-diameter retracting section 3062 is a straight surface. The first peripheral segment 312 of the ratchet holder 31 has at least one locking member 37 expanding or retracting in the polygonal groove 311 along the small-diameter contacting section 3061 and the large-diameter retracting section 3062 of the guiding portion 306. In this embodiment, the at least one locking member 37 is a ball, and the first peripheral segment 312 of the ratchet holder 31 has a blind hole 315 defined thereon to extend a part of the at least one locking member 37 out of the polygonal groove 311 or to remove the part of the at least one locking member 37 from the polygonal groove 311.

Figure 6:
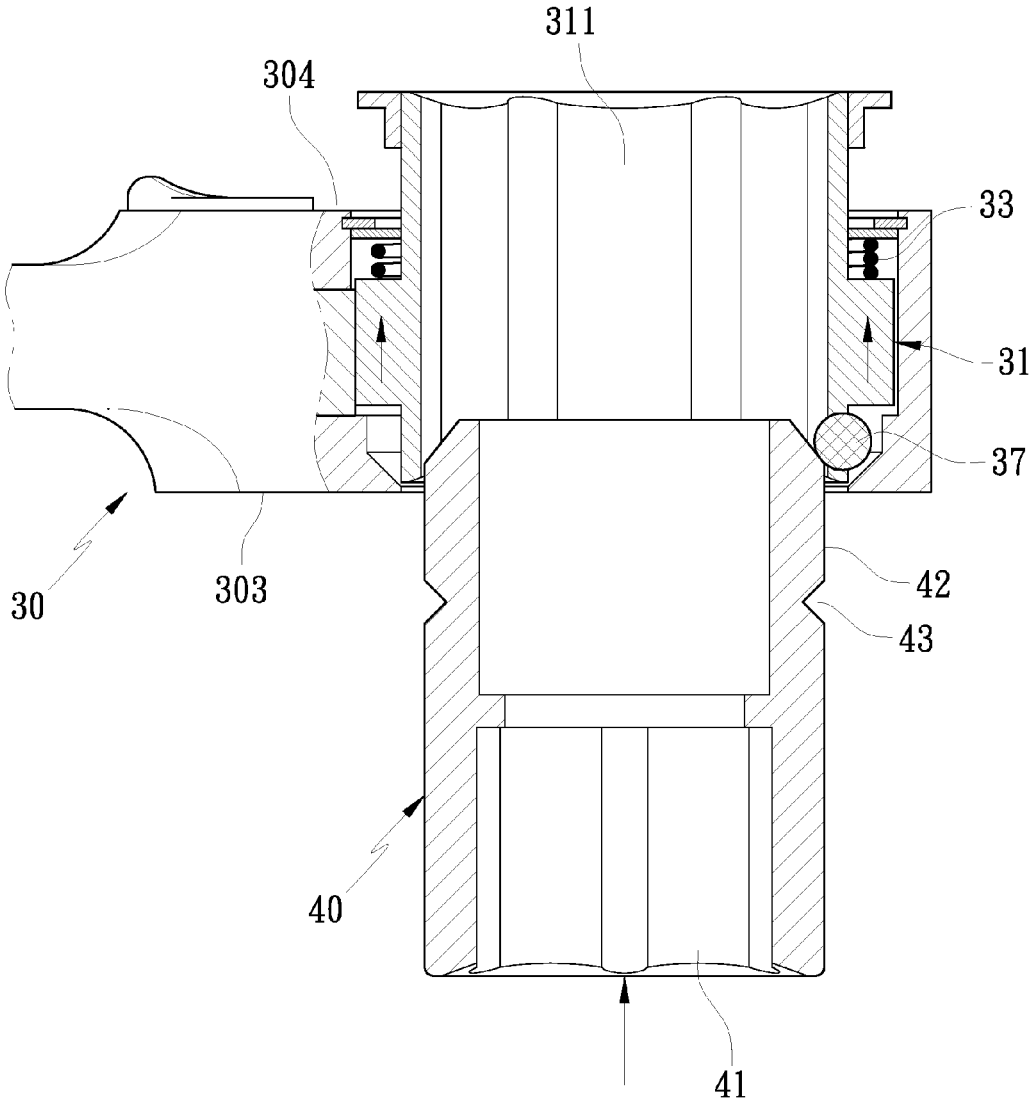
FIG. 6 is a cross sectional view showing the operation of the socket wrench according to the first embodiment of the present invention.

Referring to FIG. 6, the socket tool 40 has a working segment 41 and a fitting segment 42, wherein the working segment 41 corresponds to a bolt, and the fitting segment 42 is hexagonal and is fitted in the polygonal groove 311 of the ratchet holder 31, wherein the fitting segment 42 has a slot 43 defined on a predetermined position thereof to cooperate with the at least one locking member 37. For example, when the polygonal groove 311 of the ratchet holder 31 is fitted with the socket tool 40, the socket tool 40 is forced so that the fitting segment 42 pushes the at least one locking member 37, and then the at least one locking member 37 drives the ratchet holder 31 to press the elastic element 33, by which the elastic element 33 moves toward the second face 304 of the body 30.

Figure 7:
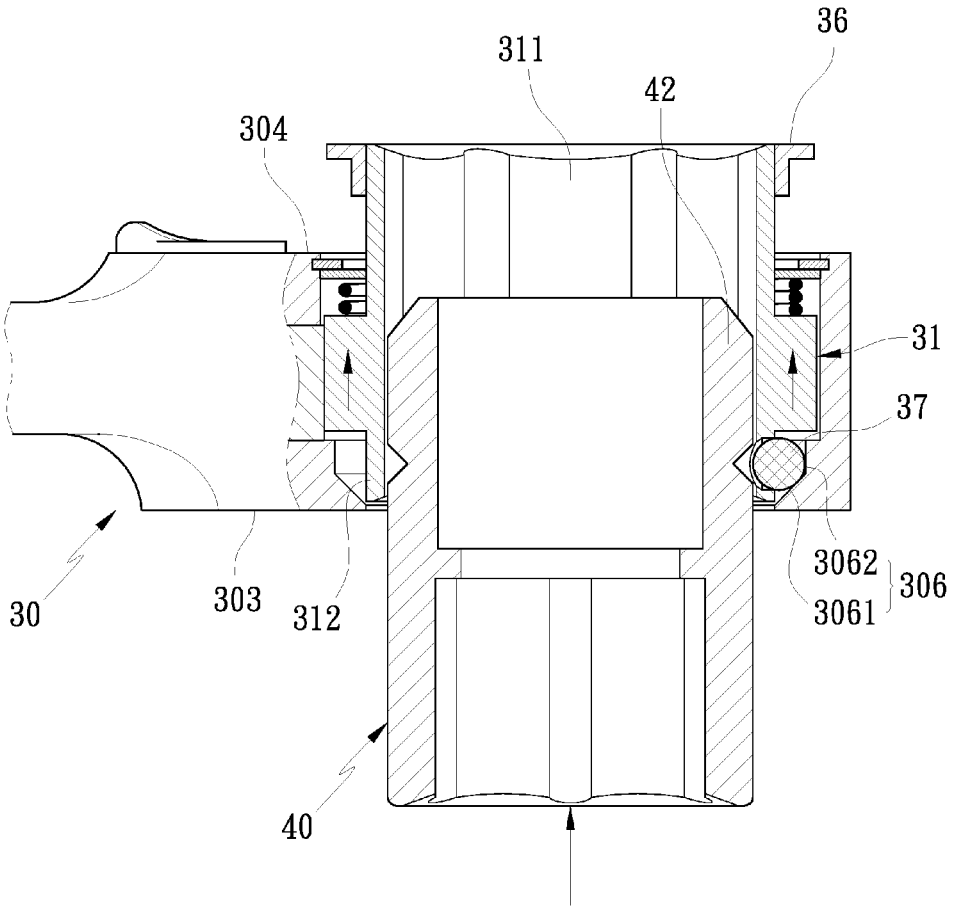
FIG. 7 is also another cross sectional view showing the operation of the socket wrench according to the first embodiment of the present invention.

As shown in FIG. 7, when the ratchet holder 31 keeps moving toward the second face 304 of the body 30, and the at least one locking member 37 of the first peripheral segment 312 corresponds to the large-diameter retracting section 3062 of the guiding portion 306, the fitting segment 42 pushes the at least one locking member 37 to move into the large-diameter retracting section 3062, after the at least one locking member 37 moves away from the polygonal groove 311, hence the fitting segment 42 of the socket tool 40 fits into the polygonal groove 311 of the ratchet holder 31.

Figure 8:
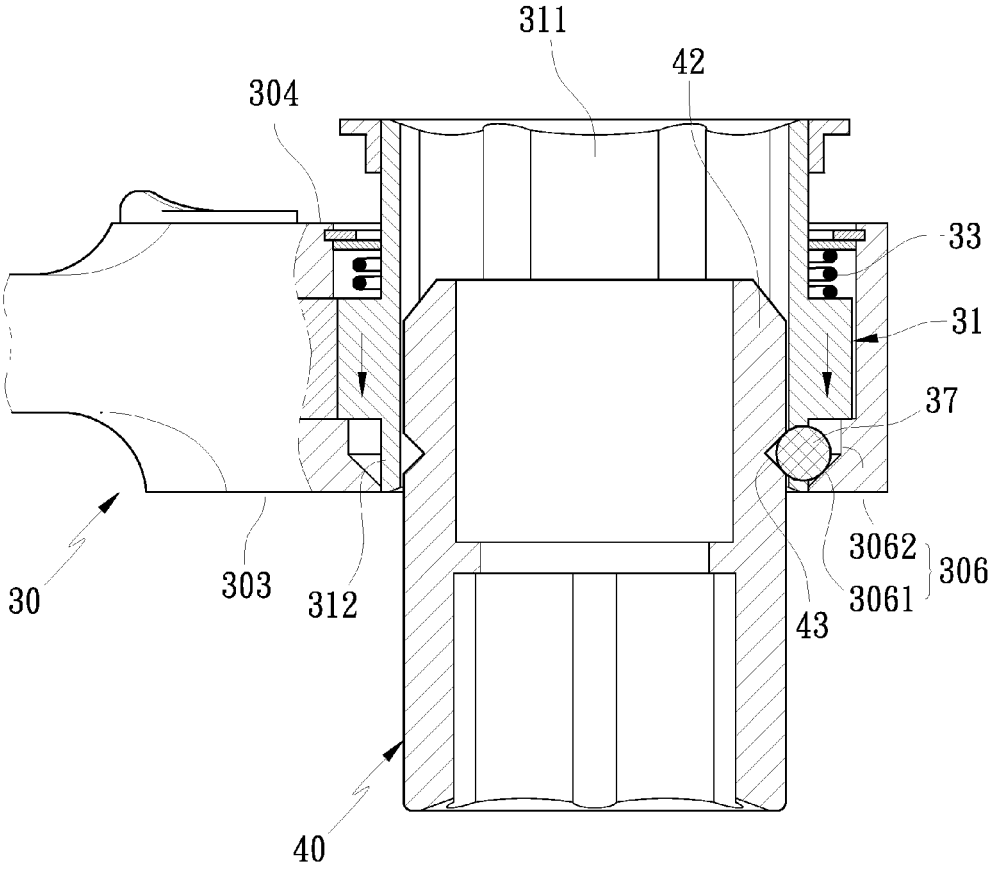
FIG. 8 is still another cross sectional view showing the operation of the socket wrench according to the first embodiment of the present invention.

As illustrated in FIG. 8, after the fitting segment 42 of the socket tool 40 fits into the polygonal groove 311 of the ratchet holder 31, the socket tool 40 is not forced so that the ratchet holder 31 moves toward the first face 303 of the body 30 by ways of the elastic element 33, the at least one locking member 37 of the first peripheral segment 312 corresponds to the small-diameter contacting section 3061 of the guiding portion 306, and the small-diameter contacting section 3061 pushes the at least one locking member 37 to extend out of the polygonal groove 311 and to retain in the slot 43 of the socket tool 40. Due to the at least one locking member 37 is pushed by the small-diameter contacting section 3061, the socket tool 40 is fixed in the polygonal groove 311 securely.

Figure 9:
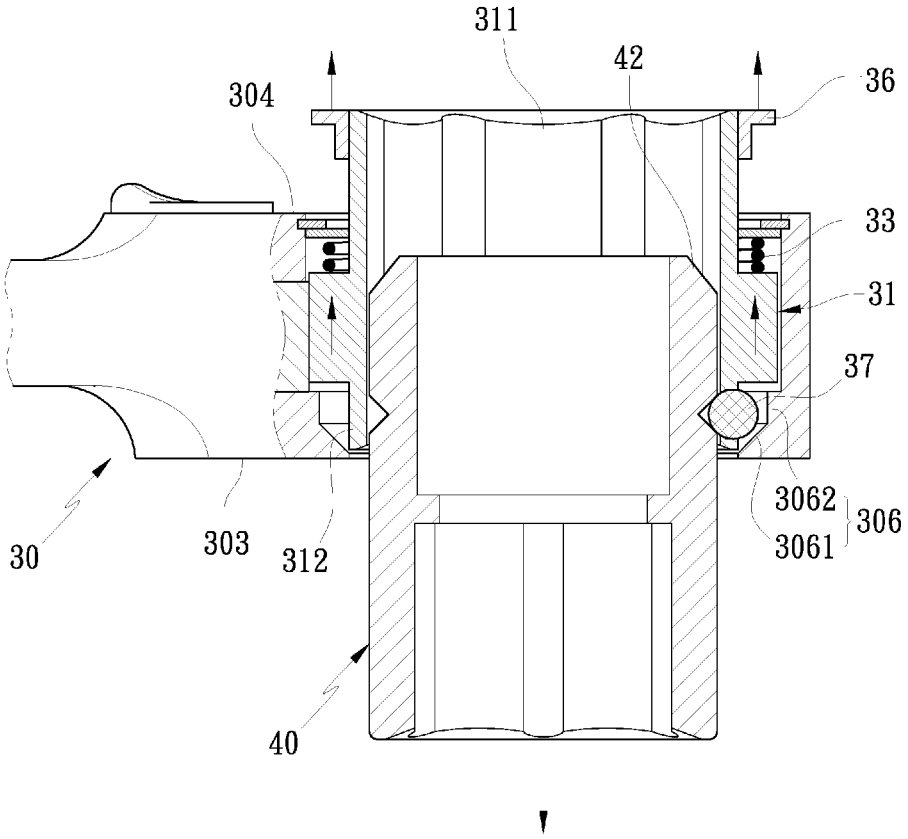
FIG. 9 is another cross sectional view showing the operation of the socket wrench according to the first embodiment of the present invention.

With reference to FIG. 9, when replacing the socket tool 40, the annular fixer 36 is pulled to drive the ratchet holder 31 to press the elastic element 33, such that the elastic element 33 moves toward the second face 304 of the body 30, the at least one locking member 37 of the first peripheral segment 312 corresponds to the large-diameter retracting section 3062 of the guiding portion 306, hence the at least one locking member 37 moves away from the polygonal groove 311 by ways of the large-diameter retracting section 3062.

Figure 10:
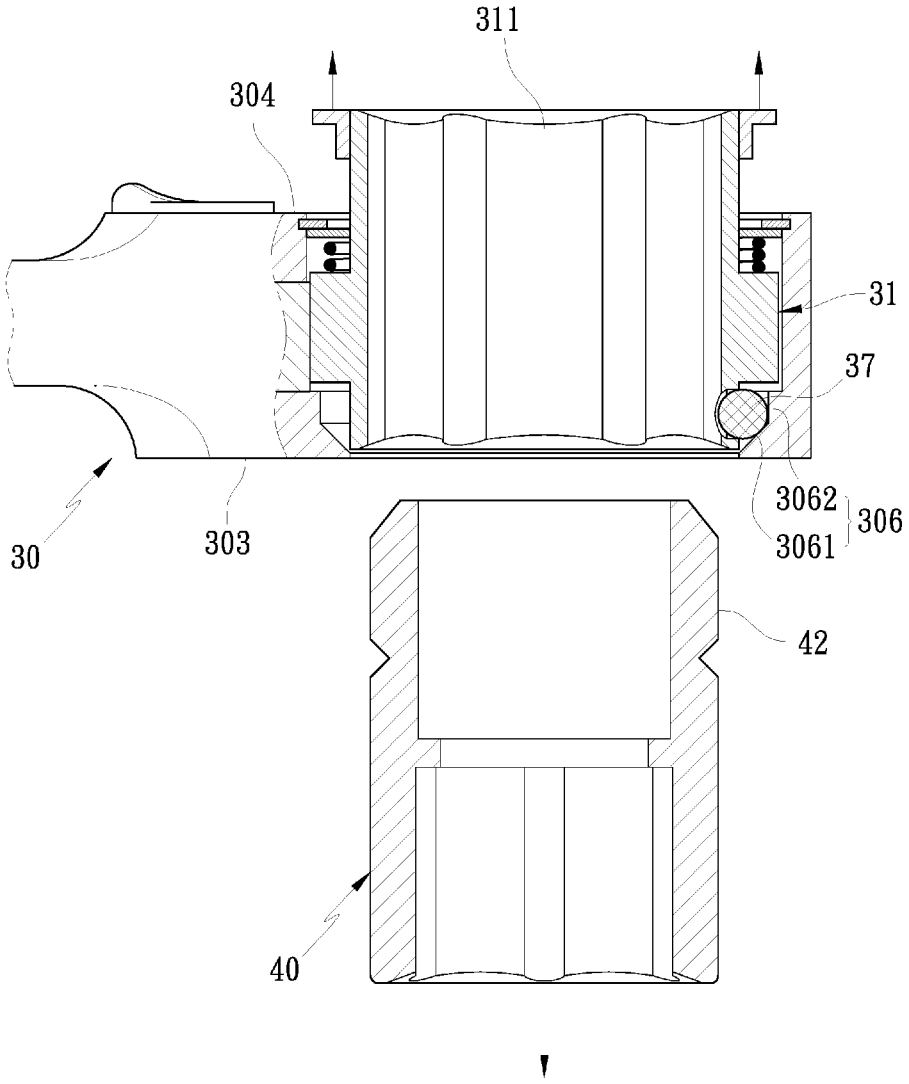
FIG. 10 is also another cross sectional view showing the operation of the socket wrench according to the first embodiment of the present invention.

Referring further to FIG. 10, since the at least one locking member 37 moves away from the polygonal groove 311 by ways of the large-diameter retracting section 3062, when the fitting segment 42 of the socket tool 40 removes from the polygonal groove 311 of the ratchet holder 31, the fitting segment 42 of the socket tool 40 pushes the at least one locking member 37 to retract into the large-diameter retracting section 3062, such that the at least one locking member 37 removes from the polygonal groove 311 of the ratchet holder 31, and the socket tool 40 removes from the ratchet holder 31, thus replacing the socket tool 40 easily.

Figure 11:
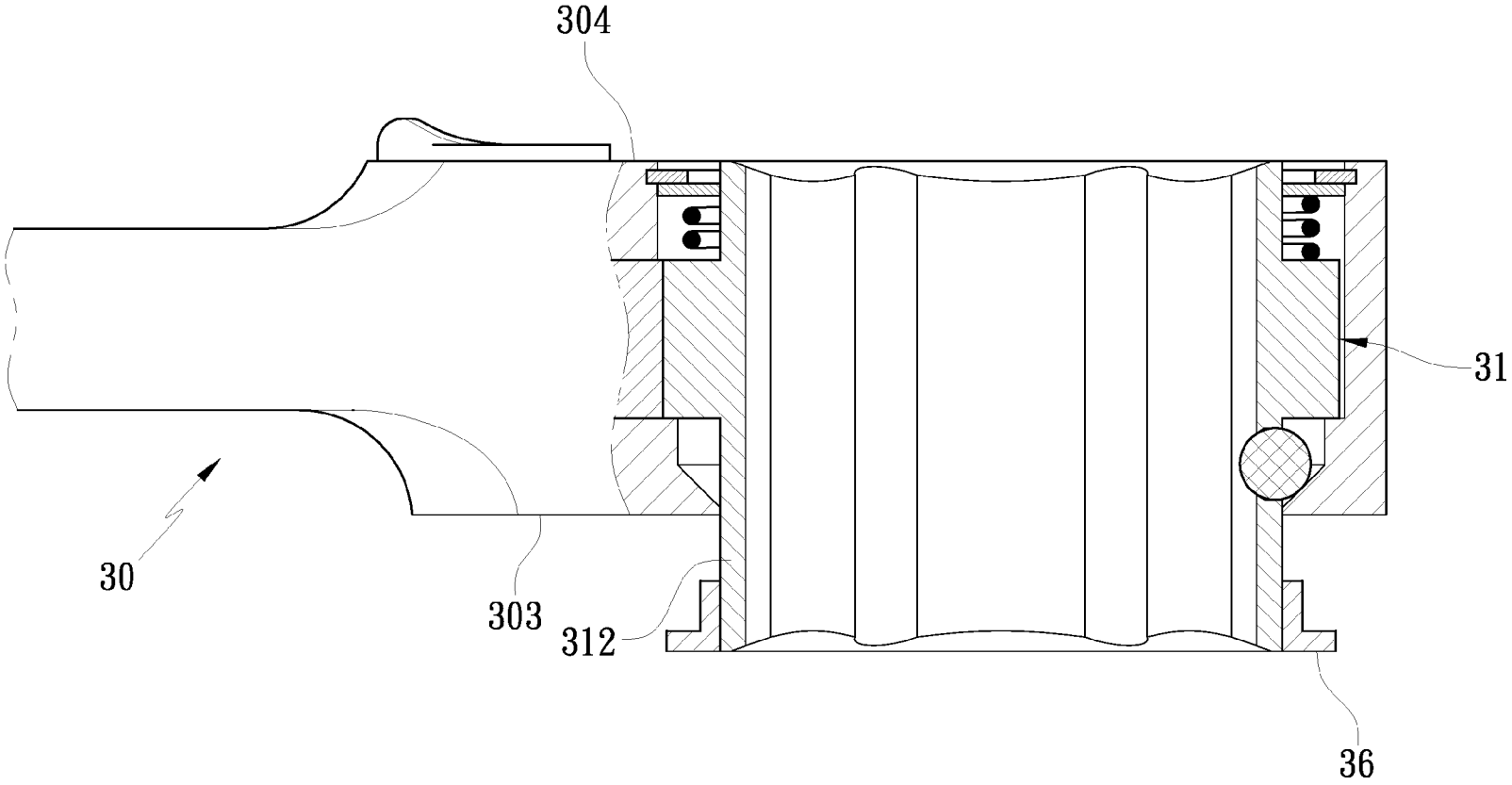
FIG. 11 is a cross sectional view showing the assembly of a part of a socket wrench according to a second embodiment of the present invention.
Figure 12:
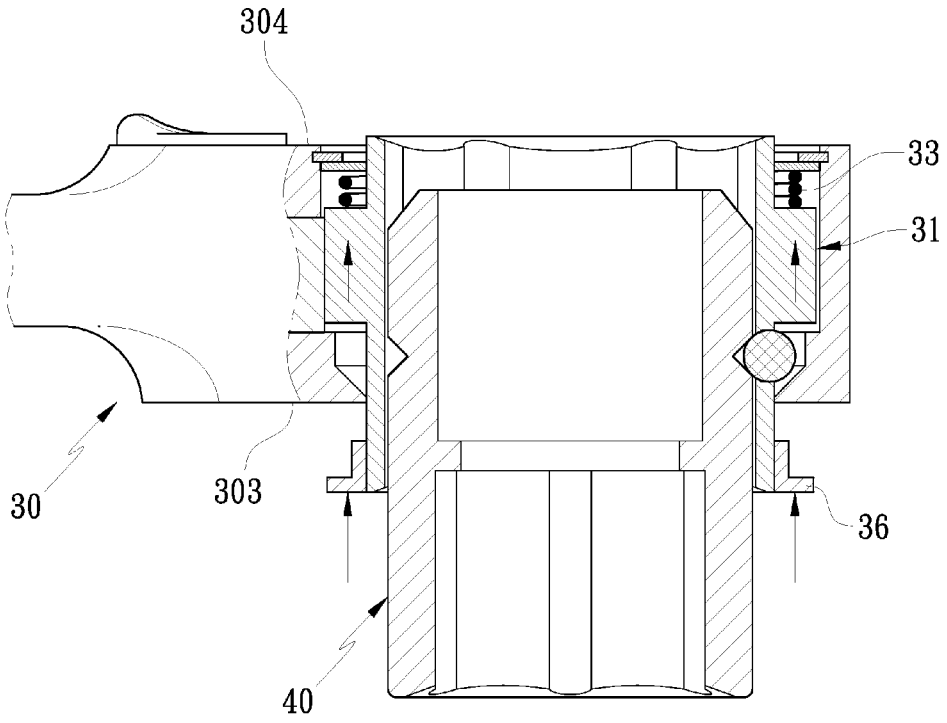
FIG. 12 is a cross sectional view showing the operation of the socket wrench according to the second embodiment of the present invention.

As shown in FIG. 11, a difference of a socket wrench of a second embodiment from that of the first embodiment comprises: an end portion of a first peripheral segment 312 of a ratchet holder 31 extends out of a first face 303 of a body 30, and the first peripheral segment 312 has an annular fixer 36 fixed on the end portion thereof. As illustrated in FIG. 12, the annular fixer 36 is mounted on the first face 303 of the body 30, such that the annular fixer 36 is pressed so that the ratchet holder 31 presses the elastic element 33 to move toward the second face 304 of the body 30, thus fitting, clamping, and replacing the socket tool 40 as well.

Figure 13:
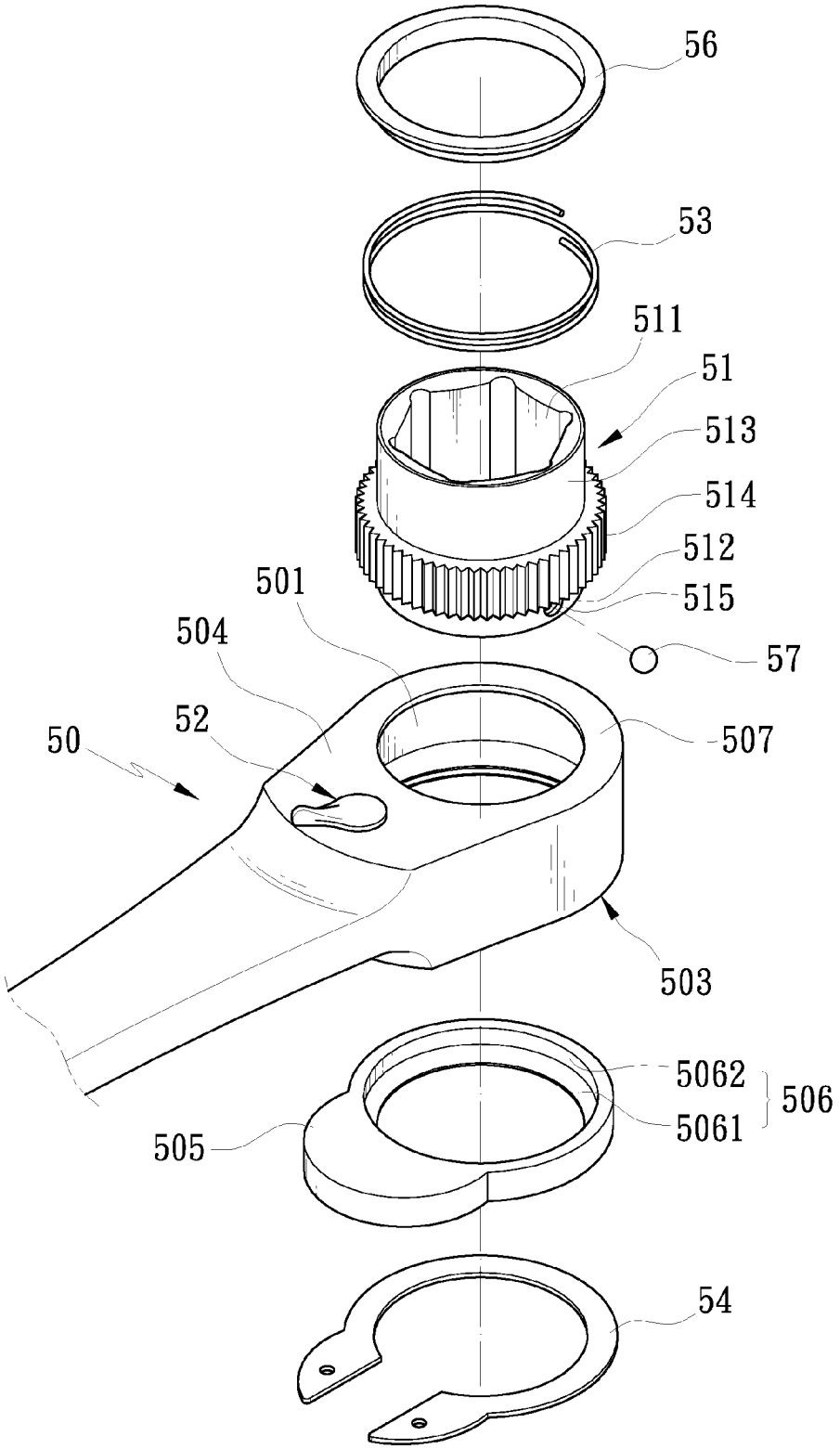
FIG. 13 is a perspective view showing the exploded components of a socket wrench according to a third embodiment of the present invention.
Figure 14:
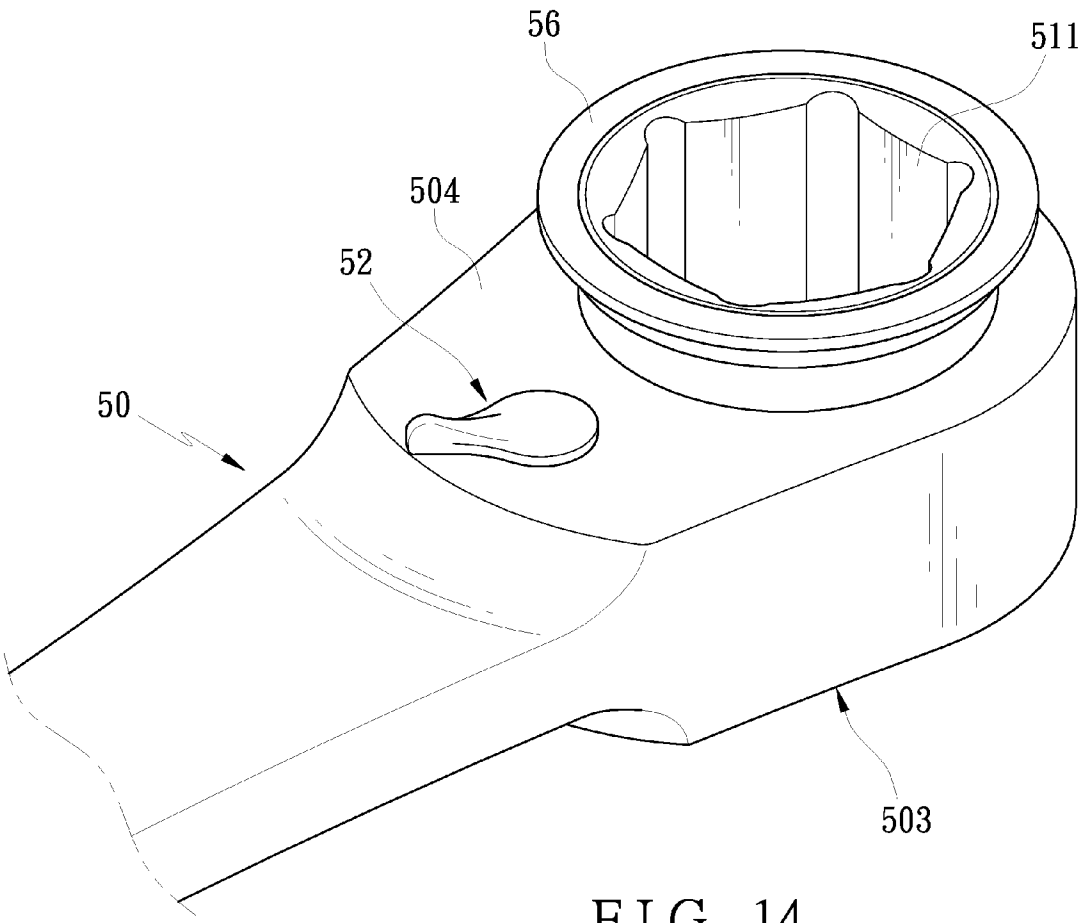
FIG. 14 is a perspective view showing the assembly of a part of the socket wrench according to the third embodiment of the present invention.
Figure 15:
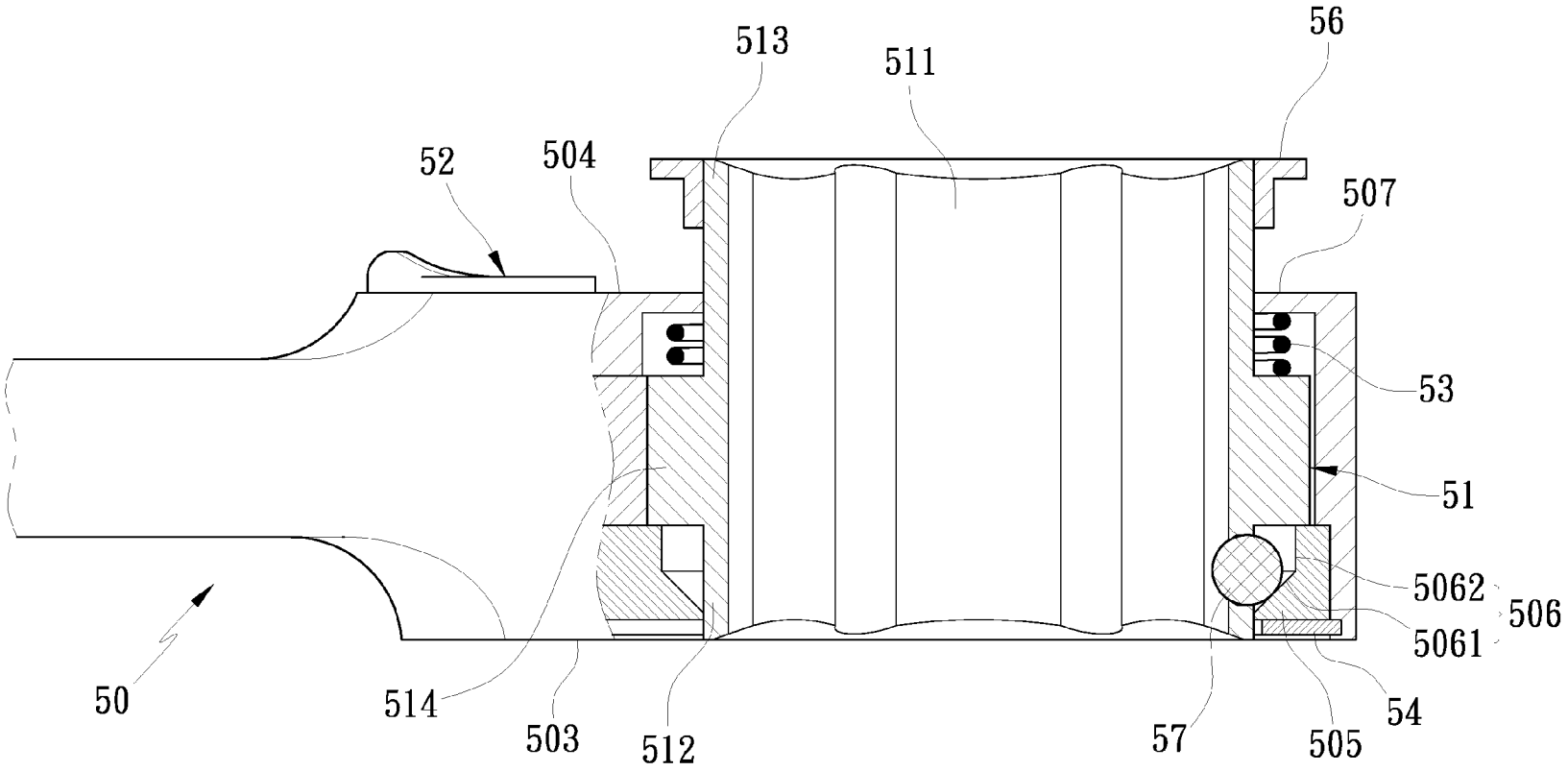
FIG. 15 is a cross sectional view showing the assembly of a part of the socket wrench according to the third embodiment of the present invention.

With reference to FIGS. 13 to 15, a socket wrench of a third embodiment from that of the first embodiment comprises: a body 50. The body 50 includes an accommodating cavity 501 defined in at least one end thereof, a first face 503, and a second face 504. The accommodating cavity 501 of the body 50 has a stepped shoulder 507 arranged on the second face 504. In this embodiment, the stepped shoulder 507 are directly formed on the second face 504 of the body 50, and a ratchet holder 51 is accommodated in the accommodating cavity 501 and has a polygonal groove 511 formed therein to fit with a socket tool. The ratchet holder 51 also has a first peripheral segment 512 and a second peripheral segment both arranged on an outer wall of the ratchet holder 51. The ratchet holder 51 further has a toothed portion 514 defined between the first peripheral segment 512 and the second peripheral segment 513. The second peripheral segment 513 of the ratchet holder 51 is inserted into the stepped shoulder 507 of the accommodating cavity 501, and the second peripheral segment 513 has an elastic element 53 fitted thereon, wherein an outer diameter of the toothed portion 514 is greater than those of the first peripheral segment 512 and the second peripheral segment 513, such that one end of the toothed portion 514 abuts against the elastic element 53, and one end of the elastic element 53 is biased against an inner wall of the stepped shoulder 507. In addition, the toothed portion 514 engages with a ratchet driving device 52 beside the accommodating cavity 501 of the body 50, such that the ratchet driving device 52 drives the ratchet holder 51 to rotate in the accommodating cavity 501 of the body 50. Since the ratchet driving device 52 is a well-known art, further remarks are omitted. The first peripheral segment 512 of the ratchet holder 51 is inserted into the first face 503 of the body 50, and the accommodating cavity 501 of the body 50 has a stop ring 505 arranged on the first face 503 to limit the ratchet holder 51 on the stop ring 505, wherein the stop ring 505 is limited by a limiting element 54. In this embodiment, the limiting element 54 is a resilient C retainer for abutting an inner wall of the accommodating cavity 501, such that the elastic element 53 is forced to press the ratchet holder 51 to move toward the second face 504 of the body 50. In this embodiment, the second peripheral segment 513 of the ratchet holder 51 extends out of the second face 504 of the body 50 and has an annular fixer 56 disposed thereon, such that the annular fixer 56 is pulled so that the ratchet holder 51 presses the elastic element 53 to move toward the second face 504 of the body 50. Furthermore, the sock wrench further comprises a clamping device, wherein the clamping device includes a guiding portion 506 arranged on the inner wall of the stop ring 505 of the accommodating cavity 501, and the guiding portion 506 has a small-diameter contacting section 5061 and a large-diameter retracting section 5062, wherein the small-diameter contacting section 5061 is located adjacent to the first face 503 of the body 50, and the small-diameter contacting section 5061 and the large-diameter retracting section 5062 are connected together to form a continuously tilted surface or a continuously stepped surface. In this embodiment, the small-diameter contacting section 5061 is a tilted surface, and the large-diameter retracting section 5062 is a straight surface. The first peripheral segment 512 of the ratchet holder 51 has at least one locking member 57 expanding or retracting in the polygonal groove 511 along the small-diameter contacting section 5061 and the large-diameter retracting section 5062 of the guiding portion 306. In this embodiment, the at least one locking member 57 is a ball, and the first peripheral segment 512 of the ratchet holder 51 has a blind hole 515 defined thereon to extend a part of the at least one locking member 57 out of the polygonal groove 511 or to remove the part of the at least one locking member 57 from the polygonal groove 511.

Figure 16:
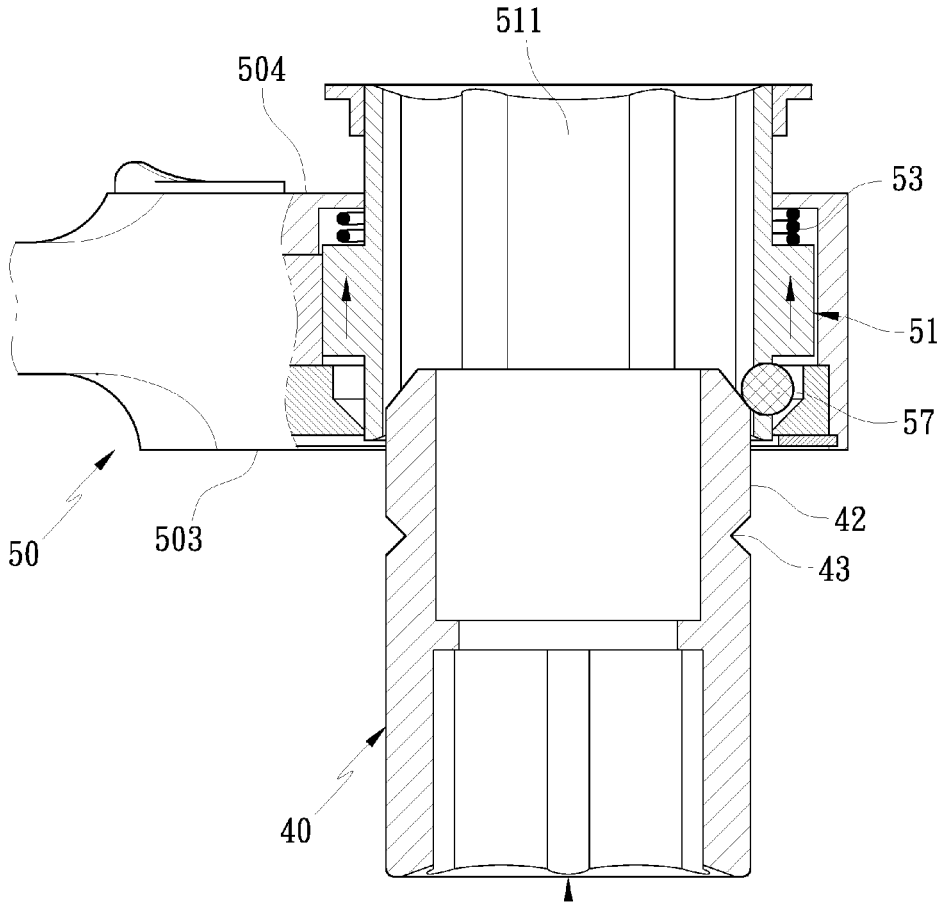
FIG. 16 is a cross sectional view showing the operation of the socket wrench according to the third embodiment of the present invention.

Referring to FIG. 16, when the polygonal groove 511 of the ratchet holder 51 is fitted with the socket tool 40, the fitting segment 42 pushes the at least one locking member 57, and then the at least one locking member 57 drives the ratchet holder 51 to press the elastic element 53, by which the elastic element 53 moves toward the second face 504 of the body 50.

Figure 17:
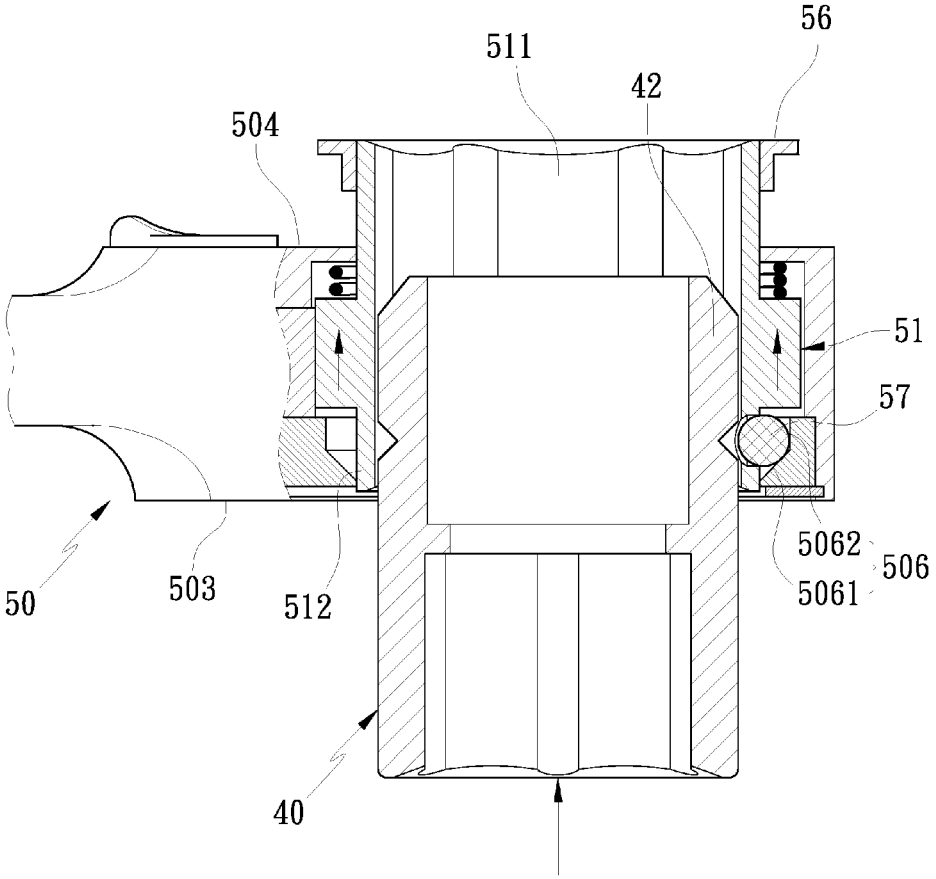
FIG. 17 is another cross sectional view showing the operation of the socket wrench according to the third embodiment of the present invention.

As shown in FIG. 17, when the ratchet holder 51 keeps moving toward the second face 504 of the body 50, and the at least one locking member 57 of the first peripheral segment 512 corresponds to the large-diameter retracting section 5062 of the guiding portion 506, the fitting segment 42 of the socket tool 40 pushes the at least one locking member 57 to move into the large-diameter retracting section 5062, after the at least one locking member 57 moves away from the polygonal groove 511, hence the fitting segment 42 of the socket tool 40 fits into the polygonal groove 511 of the ratchet holder 51.

Figure 18:
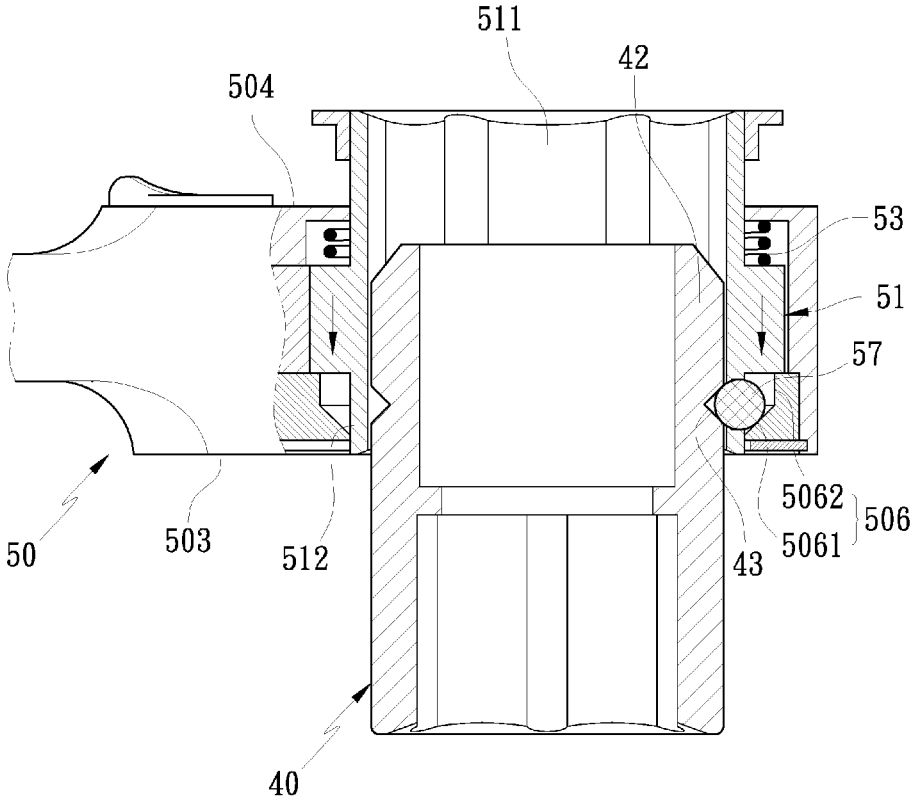
FIG. 18 is also another cross sectional view showing the operation of the socket wrench according to the third embodiment of the present invention.

As illustrated in FIG. 18, after the fitting segment 42 of the socket tool 40 fits into the polygonal groove 511 of the ratchet holder 51, the socket tool 40 is not forced so that the ratchet holder 51 moves toward the first face 503 of the body 50 by ways of the elastic element 53, the at least one locking member 57 of the first peripheral segment 512 corresponds to the small-diameter contacting section 5061 of the guiding portion 506, and the small-diameter contacting section 5061 pushes the at least one locking member 57 to extend out of the polygonal groove 511 and to retain in the slot 43 of the socket tool 40. Due to the at least one locking member 57 is pushed by the small-diameter contacting section 5061, the socket tool 40 is fixed in the polygonal groove 511 securely.

Figure 19:
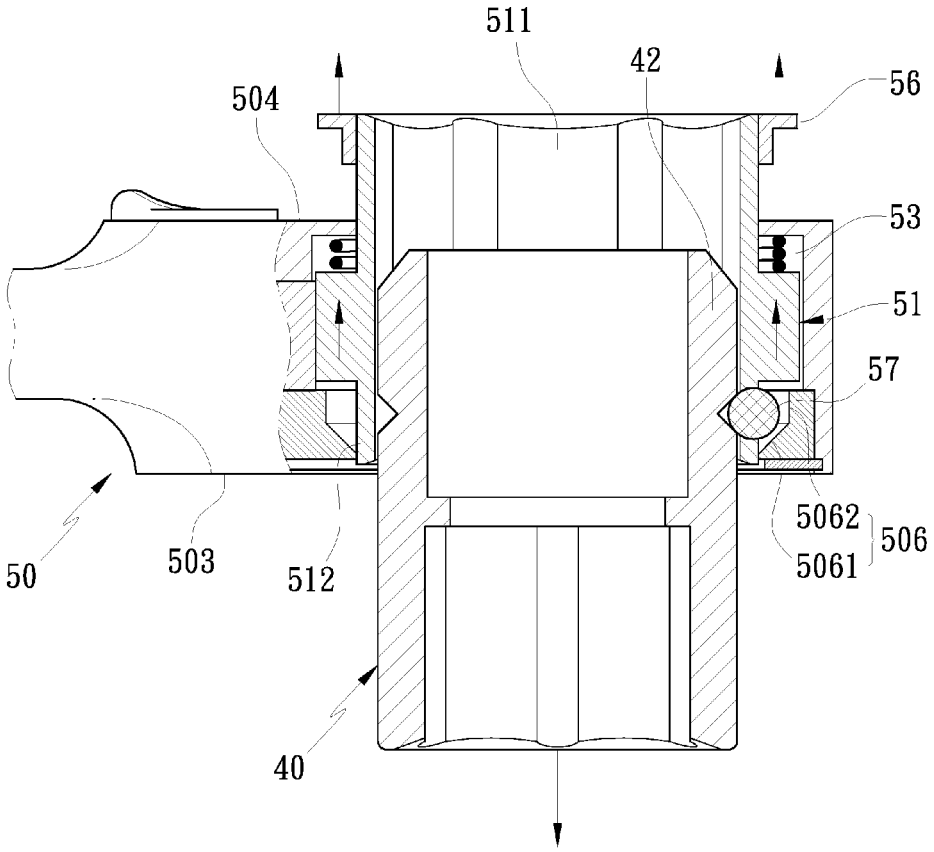
FIG. 19 is still another cross sectional view showing the operation of the socket wrench according to the third embodiment of the present invention.

With reference to FIG. 19, when replacing the socket tool 40, the annular fixer 56 is pulled to drive the ratchet holder 51 to press the elastic element 53, such that the elastic element 53 moves toward the second face 504 of the body 50, the at least one locking member 57 of the first peripheral segment 512 corresponds to the large-diameter retracting section 5062 of the guiding portion 506, hence the at least one locking member 57 moves away from the polygonal groove 511 by ways of the large-diameter retracting section 5062.

Figure 20:
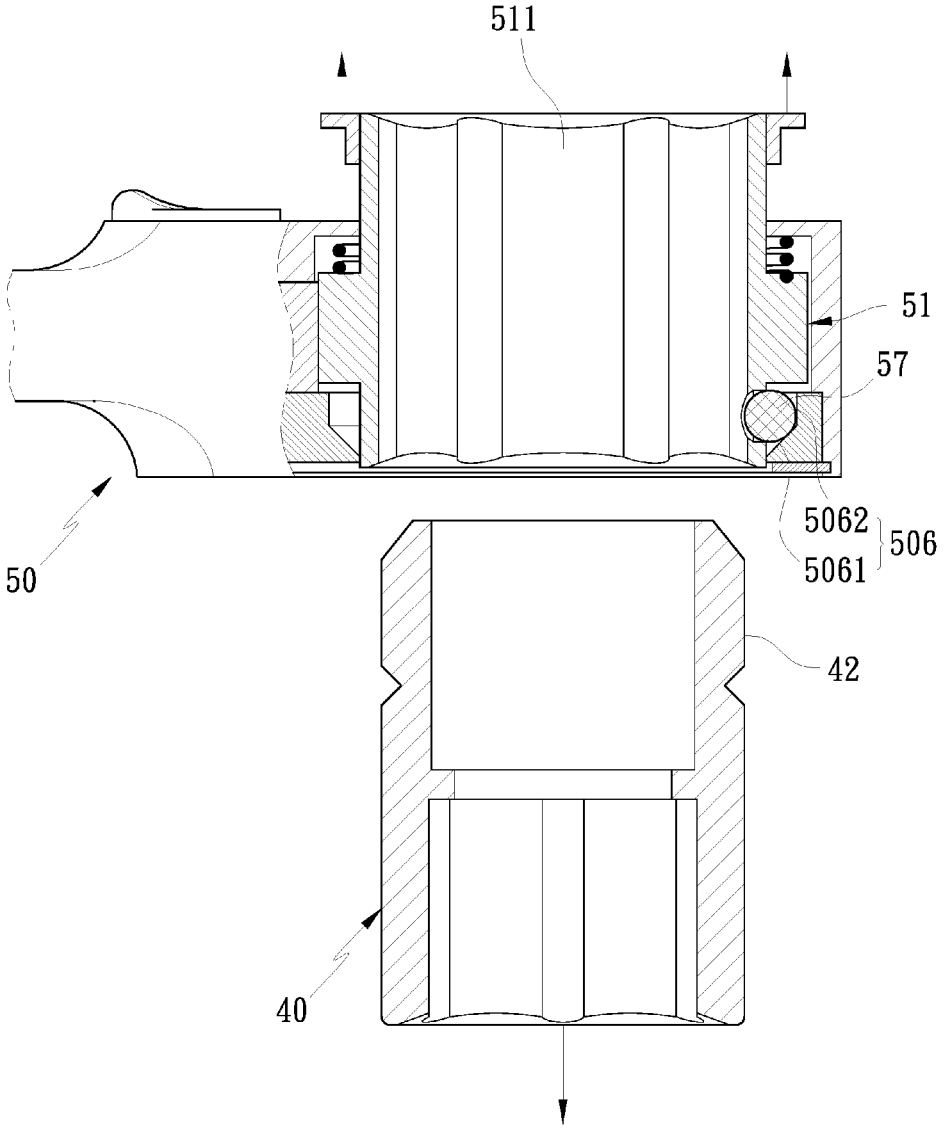
FIG. 20 is another cross sectional view showing the operation of the socket wrench according to the third embodiment of the present invention.

Referring further to FIG. 20, since the at least one locking member 57 moves away from the polygonal groove 511 by ways of the large-diameter retracting section 5062, when the fitting segment 42 of the socket tool 40 removes from the polygonal groove 511 of the ratchet holder 51, the fitting segment 42 of the socket tool 40 pushes the at least one locking member 57 to retract into the large-diameter retracting section 5062, such that the at least one locking member 57 removes from the polygonal groove 511 of the ratchet holder 51, and the socket tool 40 removes from the ratchet holder 51, thus replacing the socket tool 40 easily.

Figure 21:
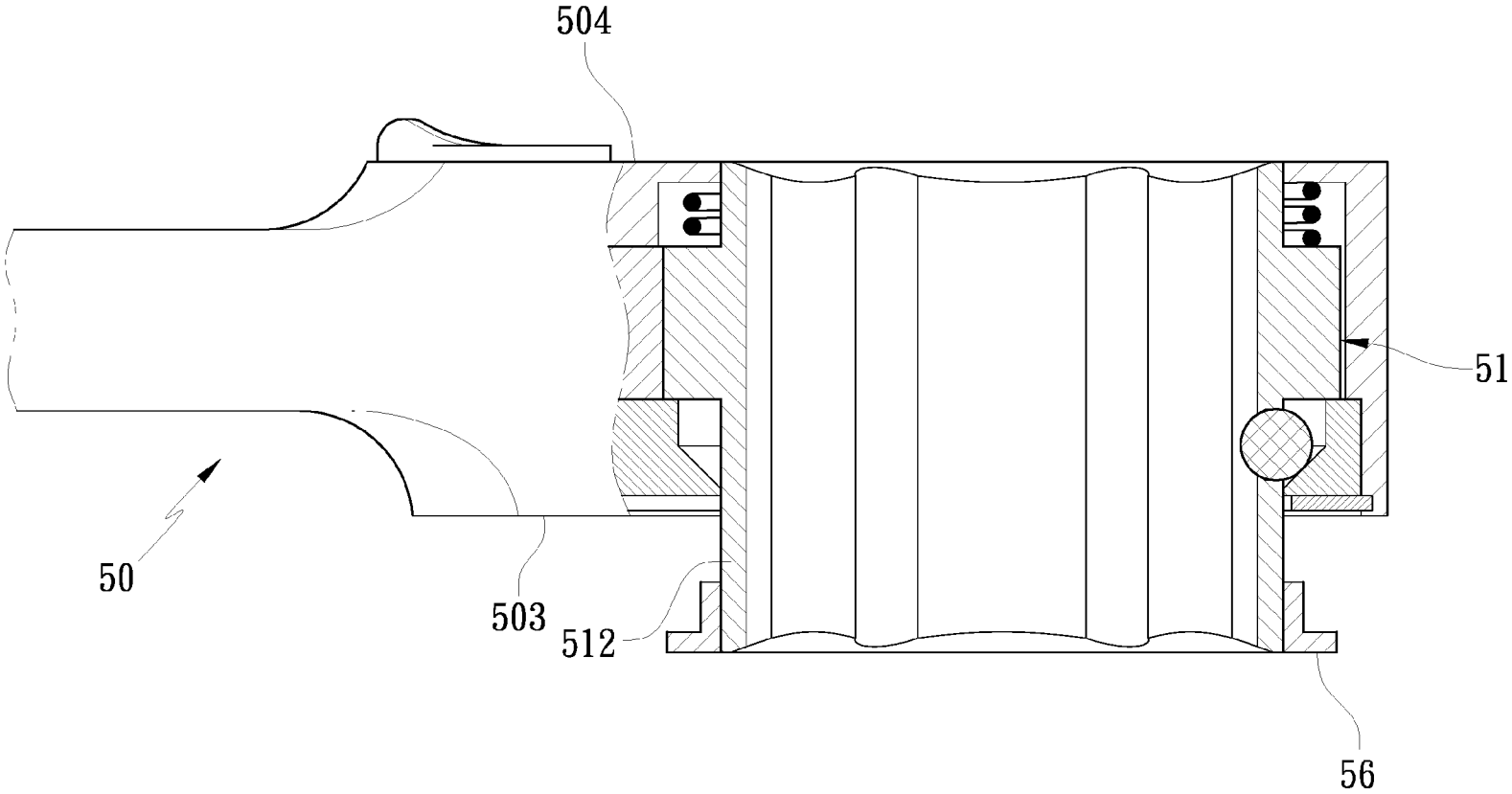
FIG. 21 is a cross sectional view showing the assembly of a socket wrench according to a fourth embodiment of the present invention.
Figure 22:
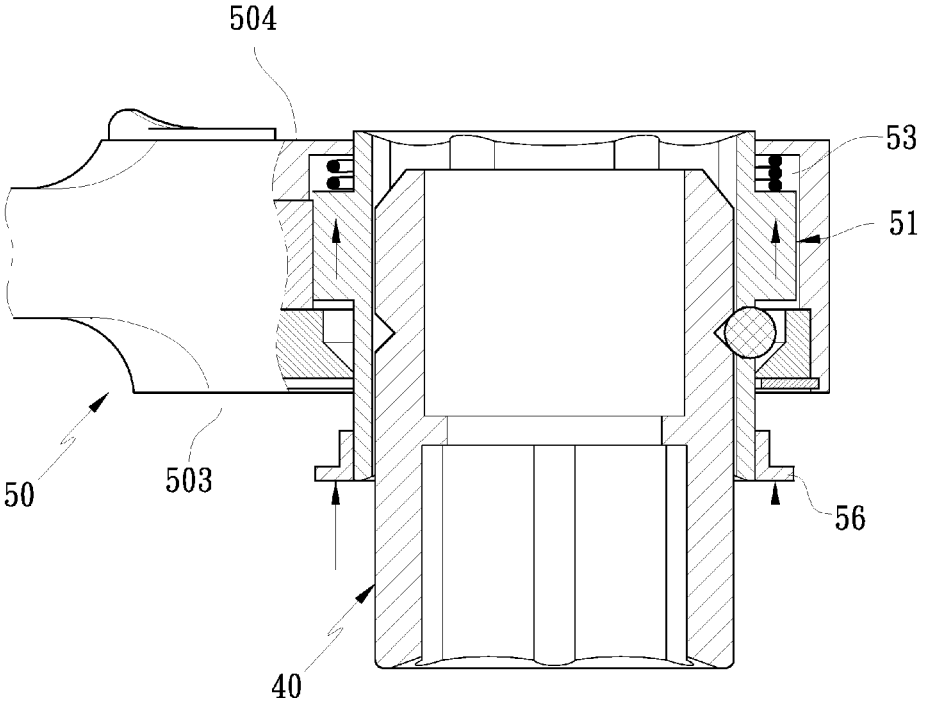
FIG. 22 is a cross sectional view showing the assembly of the socket wrench according to the fourth embodiment of the present invention.

As shown in FIG. 21, a difference of a socket wrench of a fourth embodiment from that of the third embodiment comprises: an end portion of a first peripheral segment 512 of a ratchet holder 51 extends out of a first face 503 of a body 50, and the first peripheral segment 512 has an annular fixer 56 fixed on the end portion thereof. As illustrated in FIG. 22, the annular fixer 56 is mounted on the first face 503 of the body 50, such that the annular fixer 56 is pressed so that the ratchet holder 51 presses the elastic element 53 to move toward the second face 504 of the body 50, thus fitting, clamping, and replacing the socket tool 40 as well While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A socket wrench comprising:

a body including a first face, a second face, and an accommodating cavity defined in at least one end thereof, the accommodating cavity having a stop ring arranged on the first face;

a ratchet holder accommodated in the accommodating cavity of the body and having a polygonal groove formed therein, the ratchet holder also having a first peripheral segment and a second peripheral segment both arranged on an outer wall thereof, the ratchet holder further having a toothed portion defined between the first peripheral segment and the second peripheral segment, wherein the first peripheral segment is inserted through the stop ring of the accommodating cavity, the toothed portion engages with a ratchet driving device beside the accommodating cavity of the body, the second peripheral segment of the ratchet holder is inserted into the second face of the body and has an elastic element fitted thereon;

a clamping device including a guiding portion arranged on an inner wall of the stop ring of the body, and the guiding portion having a small-diameter contacting section and a large-diameter retracting section, wherein the small-diameter contacting section is located adjacent to the first face of the body, and the first peripheral segment of the ratchet holder has at least one locking member expanding or retracting in the polygonal groove along the small-diameter contacting section and the large-diameter retracting section of the guiding portions;

wherein the accommodating cavity of the body has the stop ring directly formed on the first face, an outer diameter of the toothed portion of the ratchet holder is greater than those of the first peripheral segment and the second peripheral segment, such that one end of the toothed portion abuts against the inner wall of the stop ring; and wherein the second peripheral segment of the ratchet holder has a circular loop fitted thereon, a first end of the elastic element abuts against the toothed portion, a second of the elastic element is biased against the circular loop, the circular loop is limited by a limiting element, and the ratchet holder is limited in the accommodating cavity.

2. The socket wrench as claimed in claim 1, wherein the small-diameter contacting section and the large-diameter retracting section are connected together to form a continuously tilted surface or a continuously stepped surface.

3. The socket wrench as claimed in claim 2, wherein the small-diameter contacting section is a tilted surface, and the large-diameter retracting section is a straight surface.

4. The socket wrench as claimed in claim 1, wherein the at least one locking member of the clamping device is a ball, and the first peripheral segment of the ratchet holder has a blind hole defined thereon to extend a part of the at least one locking member out of the polygonal groove or to remove the part of the at least one locking member from the polygonal groove.

5. The socket wrench as claimed in claim 1, wherein the second peripheral segment of the ratchet holder extends out of the second face of the body and has an annular fixer disposed thereon, such that the annular fixer is pulled so that the ratchet holder moves toward the second face of the body.

6. The socket wrench as claimed in claim 1, wherein the first peripheral segment of the ratchet holder extends out of the first face of the body and has an annular fixer disposed thereon, such that the annular fixer is pressed so that the ratchet holder presses the elastic element to move toward the second face of the body.

7. A socket wrench comprising:

a body including a first face, a second face, and an accommodating cavity defined in at least one end thereof, the accommodating cavity having a stop ring arranged on the first face;

a ratchet holder accommodated in the accommodating cavity of the body and having a polygonal groove formed therein, the ratchet holder also having a first peripheral segment and a second peripheral segment both arranged on an outer wall thereof, the ratchet holder further having a toothed portion defined between the first peripheral segment and the second peripheral segment, wherein the first peripheral segment is inserted through the stop ring of the accommodating cavity, the toothed portion engages with a ratchet driving device beside the accommodating cavity of the body, the second peripheral segment of the ratchet holder is inserted into the second face of the body and has an elastic element fitted thereon;

a clamping device including a guiding portion arranged on an inner wall of the stop ring of the body, and the guiding portion having a small-diameter contacting section and a large-diameter retracting section, wherein the small-diameter contacting section is located adjacent to the first face of the body, and the first peripheral segment of the ratchet holder has at least one locking member expanding or retracting in the polygonal groove along the small-diameter contacting section and the large-diameter retracting section of the guiding portion; and wherein the accommodating cavity of the body has a stepped shoulder directly formed on the second face, and an outer diameter of the toothed portion of the ratchet holder is greater than those of the first peripheral segment and the second peripheral segment, a first end of the elastic element abuts against the toothed portion, and a second of the elastic element is biased against the stepped shoulder.

8. The socket wrench as claimed in claim 7, wherein the stop ring is limited by a limiting element, and one end of the toothed portion abuts against the inner wall of the stop ring, such that the ratchet holder is limited in the accommodating cavity.

9. The socket wrench as claimed in claim 7, wherein the small-diameter contacting section and the large-diameter retracting section are connected together to form a continuously tilted surface or a continuously stepped surface.

10. The socket wrench as claimed in claim 9 wherein the small-diameter contacting section is a tilted surface, and the large-diameter retracting section is a straight surface.

11. The socket wrench as claimed in claim 7, wherein the at least one locking member of the clamping device is a ball, and the first peripheral segment of the ratchet holder has a blind hole defined thereon to extend a part of the at least one locking member out of the polygonal groove or to remove the part of the at least one locking member from the polygonal groove.

12. The socket wrench as claimed in claim 7, wherein the second peripheral segment of the ratchet holder extends out of the second face of the body and has an annular fixer disposed thereon, such that the annular fixer is pulled so that the ratchet holder moves toward the second face of the body.

13. The socket wrench as claimed in claim 7, wherein the first peripheral segment of the ratchet holder extends out of the first face of the body and has an annular fixer disposed thereon, such that the annular fixer is pressed so that the ratchet holder presses moves toward the second face of the body.

* * * * *